US005964547A

United States Patent [19]

Brinkley

[11] Patent Number: 5,964,547

[45] Date of Patent: Oct. 12, 1999

[54] CONNECTION PIN ASSEMBLY

[75] Inventor: David Wayne Brinkley, Northgate, Australia

[73] Assignee: Cutting Edge Pty. Limited, New South Wales, Australia

[21] Appl. No.: 09/123,592

[22] Filed: Jul. 28, 1998

[30] Foreign Application Priority Data

Aug. 6, 1997 [AU] Australia ..... PO8426

[51] Int. Cl.[6] ..... B25G 3/20

[52] U.S. Cl. ..... 403/374.3; 37/456

[58] Field of Search ..... 403/374.3, 374.1, 403/373, 379.4, 33; 37/456, 357

[56] References Cited

U.S. PATENT DOCUMENTS 3,032,152 5/1962 Titsler ..... 403/374.3
4,433,496 2/1984 Jones et al. ..... 403/374.3
5,438,774 8/1995 Fletcher et al. ..... 37/374.3
5,452,529 9/1995 Neuenfeldt et al. ..... 403/374.3
5,564,206 10/1996 Ruvang ..... 37/456 X

*Primary Examiner*—Lynne Reichard
*Assistant Examiner*—David E. Bochna
*Attorney, Agent, or Firm*—David P. Gordon; David S. Jacobson; Thomas A. Gallagher

[57] ABSTRACT

A connection pin assembly for attaching a replaceable implement to an earthworking bucket nose includes a spool and a wedge having respective ramping surfaces which convert relative axial movement into lateral expansion of the assembly. A screw member is located in a recess in the spool's ramping surface, a thread segment of the screw member engaging formations on the wedge to drive the axial movement.

11 Claims, 2 Drawing Sheets

CONNECTION PIN ASSEMBLY

BACKGROUND OF INVENTION

1. Field of the Invention

The present invention relates to connection pin assemblies for attaching replaceable implements to earthworking buckets of excavating equipment and the like. The invention also relates to a method of attachment, and to earthworking buckets with replaceable implements attached by means of the connection pin assemblies.

2. State of the Art

Earth working buckets used for heavy earthworks applications such as mining are fitted with teeth for engaging the ground surface. Due to the highly abrasive nature of the materials encountered by the teeth, they wear more quickly than the bucket. For this reason, they are detachably connected to the bucket to allow replacement.

On smaller buckets, the teeth are generally attached directly to an adaptor on the bucket by means of a connection pin. On larger buckets, intermediate adaptors are attached to the bucket nose and the teeth are attached to respective of the intermediate adaptors. Both connections are by means of connection pins, so that the teeth and intermediate adaptors can be replaced as required.

Connection pin assemblies of the type generally employed, and with which this invention is concerned, are known in the art as spool and wedge (or clamp and wedge) assemblies.

Prior art spool and wedge assemblies include a spool, often C-shaped with tapered engagement surfaces, which can be inserted into aligned apertures in the parts to be connected. A wedge is then inserted to contact the rear surface of the C and is driven home by sledgehammer to cause lateral expansion of the spool and wedge until it bears firmly against appropriate parts of the inner walls of the apertures to provide lateral loading and optionally a clamping action of the adaptor in the case of 'Whisler' style attachments. Any part of the spool and wedge protruding above or below the aligned apertures is then cut off by oxy acetylene equipment.

The tightness of the connections must be regularly monitored, and when a tooth or intermediate adaptor works loose the spool and wedge must be tightened by hammering the wedge in further. This can be difficult as the protruding part of the wedge may already have been removed and thus the end of the wedge is not readily accessible. When the tooth or intermediate adaptor requires replacement, the spool and wedge often has to be cut out.

It will be appreciated that the fitting, monitoring, adjustment and removal of the prior art spool and wedge assemblies is time consuming and labour intensive, particularly as each bucket will have a number of teeth and an equal number of adaptors, each attached by respective spool and wedge assemblies.

Patent Application No. PCT/AU94/00035 describes a spool and wedge assembly in which a pair of spools are forced apart by a pair of wedges which are drawn together by a bolt. While that disclosure is in some respects an improvement over the prior art, it leaves much scope for improvement. For example, the arrangement is relatively complicated, still requires regular monitoring and adjustment and, in practice, may need to be cut out for removal.

The arrangement in Australian Patent Application No. 65583/96 overcomes at least some of disadvantages by providing a spool and wedge drawn together by a bolt, and disengagement means engaging with the wedge to bear against the bolt, forcing separation of the spool and wedge.

The present invention aims to provide an alternative arrangement.

SUMMARY OF THE INVENTION

The present invention relates to a connection pin assembly for attaching a replaceable implement to an earthworking bucket, including a spool having a first ramping surface, a wedge having a second ramping surface, the first and second surface co-operating to form a ramp arrangement which causes lateral expansion of the connection pin assembly upon relative axial movement in a first direction in which said spool and wedge are drawn towards each other, and screw means associated with one of the spool and wedge, characterised in the screw means having a rotational axis substantially parallel to the respective first or second ramping surface, the other of the spool and wedge having formations which engage with a thread portion of the screw means such that rotation of the screw means drives said relative axial movement in the first direction and thereby said lateral expansion of the connection pin.

Preferably, the screw means is situated in a recess in the respective first or second ramping surface, so that a segment of the thread surface extends beyond the ramping surface to engage the formations in the ramping surface of the other element.

BRIEF DESCRIPTION OF THE DRAWINGS

Further preferred embodiments will now be described with reference to the accompanying drawings, in which.

DESCRIPTION OF THE PREFERRED EMBODIMENTS

Figure 1:
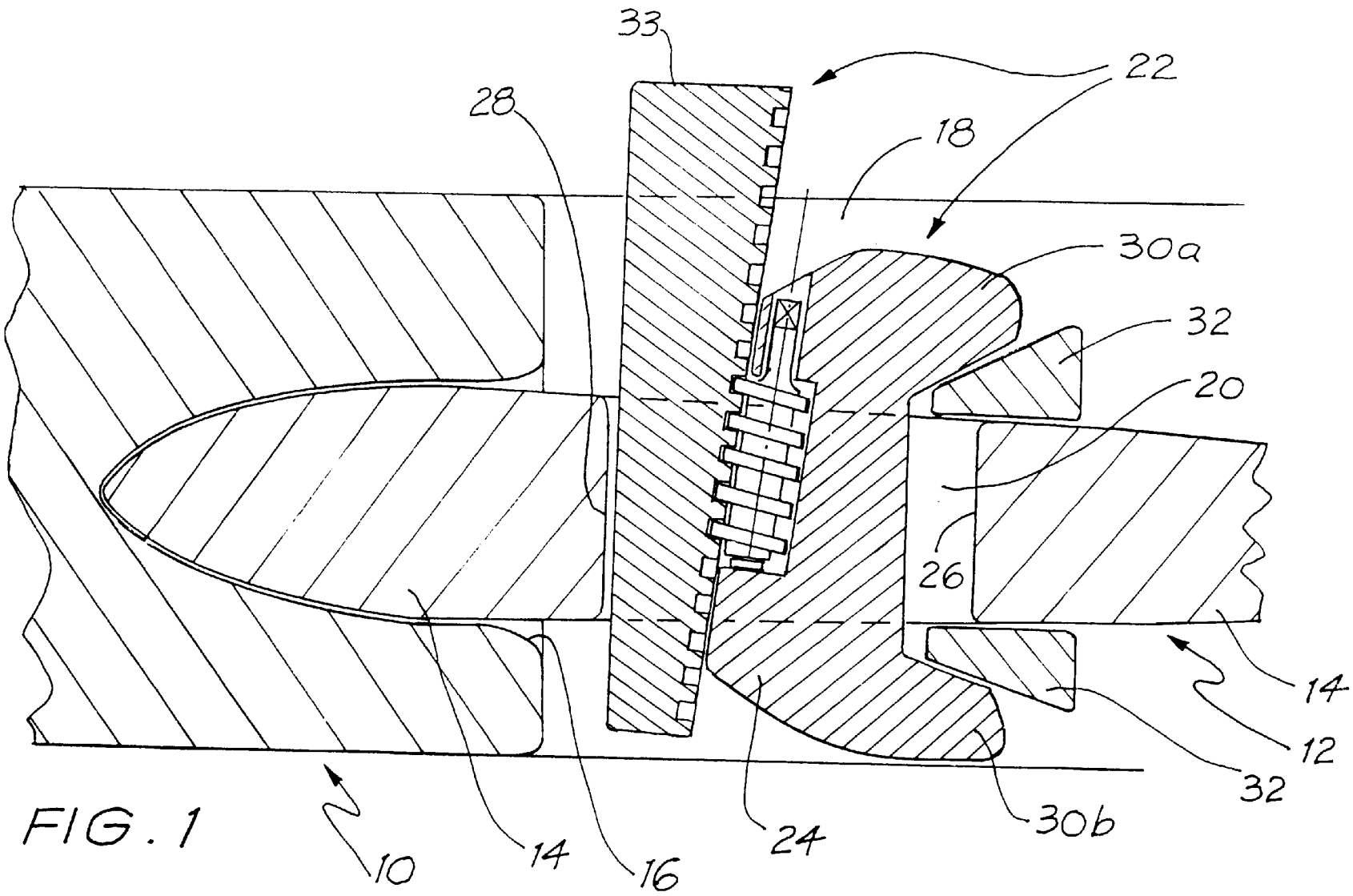
FIG. 1 is a schematic side cross-section of a spool and wedge assembly fixing the adaptor to a bucket nose of an earthworking bucket.

FIG. 1 illustrates the positioning of an excavator intermediate adaptor 10 on a bucket nose 12 using a Whisler type attachment.

The bucket has a projecting lip or nose 14 which is received in a corresponding cavity 16 of the adaptor or intermediate adaptor. When positioned properly on the bucket nose, an aperture 18 of the intermediate adaptor aligns with an aperture 20 of the bucket nose to allow insertion of a spool (or clamp) and wedge assembly 22.

The spool 24 is generally C-shaped and is dimensioned to pass between the rear 26 and front 28 walls of the aperture 20 in the bucket nose and then be positioned so that the tapered projections 30*a*, 30*b*, contact tapered blocks 32 on the intermediate adaptor either side of projection 14.

Insertion of the wedge 33 causes lateral expansion of the assembly so that the wedge bears against the front wall 28 of the bucket nose aperture 20 and the spool pushes against and squeezes in the tapered blocks 32. This forces the intermediate adaptor rearwards relative to the nose, tightening the engagement, and also clamps the tapered blocks 32 against lip or nose 14, thereby securing the intermediate adaptor to the bucket.

Figure 3:
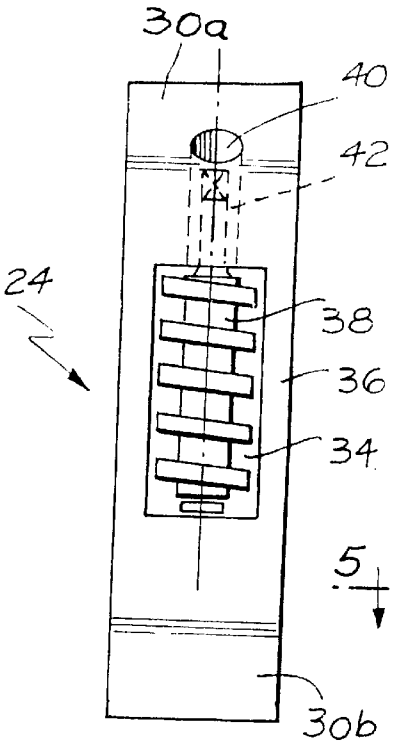
FIG. 3 is a front view of the ramping surface and screw of the spool, with the wedge removed.
Figure 2:
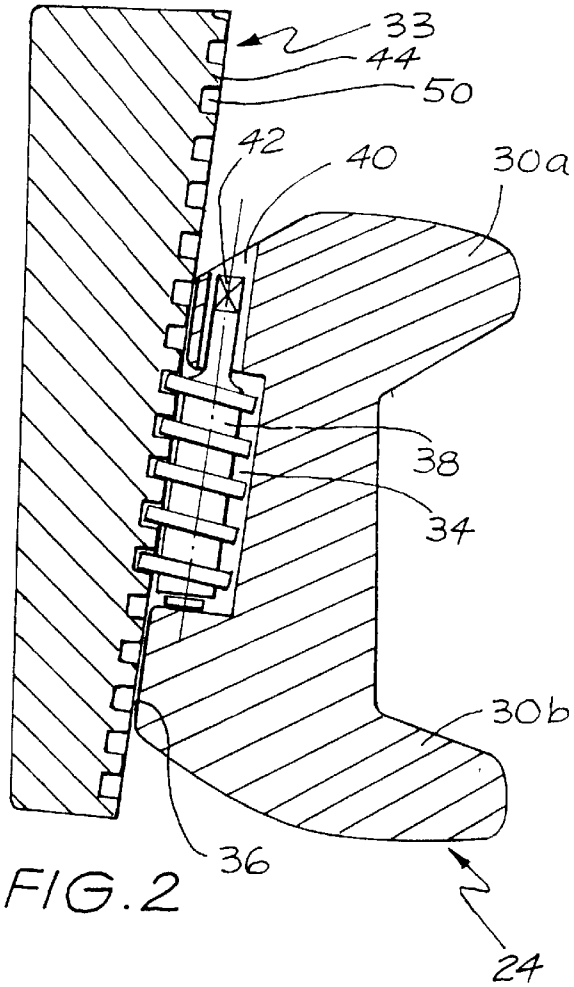
FIG. 2 is a schematic side cross-section of the spool and wedge.

Referring to FIGS. 2 and 3 the spool 24 has a recess 34 in its ramping surface 36 for receiving a screw member 38 which rotates on an axis parallel to the ramping surface. A passage 40 in the narrow end of the spool allows access to a drive block or other drive means 42 for rotating the screw.

An outermost segment of the screw thread extends beyond the ramping surface 36 to engage with formations 44 in a hollowed out portion 46 of the wedge's ramping surface 48. As the screw is rotated by use of the drive means 42, the wedge moves along the screw thread, and thus moves relative to the spool. The co-operating ramping surfaces 36, 48 on the spool and wedge translate this relative movement into lateral expansion of the assembly to tighten the connection between the bucket nose and adaptor. Rotation of the drive means in the other direction causes lateral contraction of the assembly to allow its removal from the aligned apertures.

The screw may be biased axially within the recess toward the thicker end of the spool, for example by a spring washer (not shown) or the like at the other end of the recess. As the assembly is tightened against the surfaces of the aligned apertures of the bucket nose and adaptor, the reaction force on the screw will compress the spring washer, which will decompress in the event that the assembly works slightly loose and thus provide some degree of self-tightening.

Alternatively, a serrated double washer arrangement (not shown) of the type known per se may be provided, such that any tendency for the screw to rotate in the direction causing loosening of the assembly will be resisted by serrations of the washers riding up relative to each other.

Figure 4:
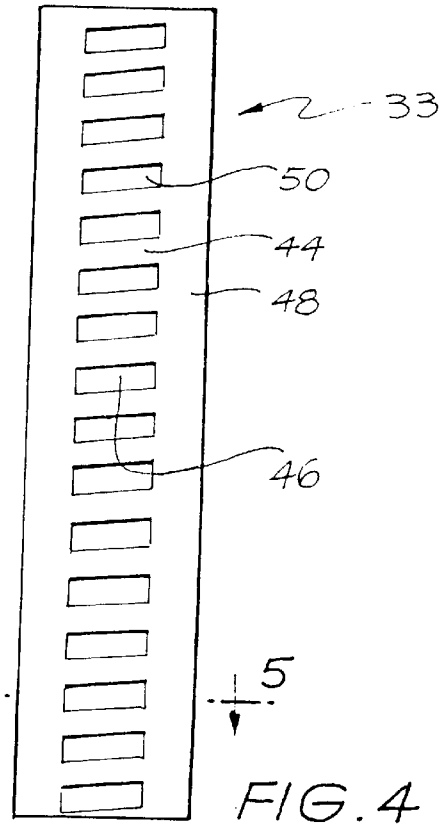
FIG. 4 is a rear view of the ramping surface of the wedge.
Figure 5:
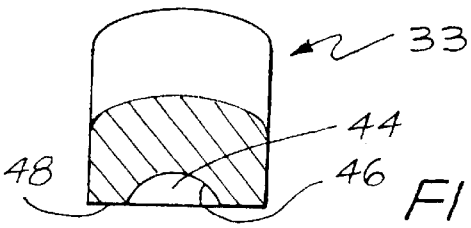
FIG. 5 is a transverse cross-section of the wedge along line 5—5 of FIG. 4.

With specific reference to FIGS. 4 and 5, it can be seen that the formations 44 on the wedge ramp surface may consist of a series of parallel projecting webs set in an arcuate (in end view) hollow in the ramping surface of the wedge. The arc defined by the hollow accommodates the segment of the screw thread which projects past the spool's ramping surface, while the projecting webs are set at the same pitch and angle as the screw thread. The gap 50 between adjacent formations is larger than the thickness of the screw thread, to allow sufficient clearance for operation under the dirty conditions in which such equipment is used.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein. For example, while the Whisler type assembly is illustrated, the invention is also applicable to spool and wedge assemblies of the type which effect lateral tightening alone without a clamping action.

I claim:

1. A connection pin assembly for attaching a replaceable implement to an earthworking bucket, comprising:

a) a spool having a first ramping surface;

b) a wedge having a second ramping surface, said first and second ramping surfaces cooperating to form a ramp arrangement which causes lateral expansion of said connection pin assembly upon relative axial movement in a first direction in which said spool and said wedge are drawn towards each other; and c) a screw means associated with one of said spool and said wedge for moving said one of said spool and said wedge axially relative to the other, substantially parallel to the respective one of said first and the other of said spool and said wedge having formations which engage with a thread portion of said screw means such that rotation of said screw means drives said relative axial movement in said first direction and thereby said lateral expansion of said connection pin assembly, wherein said thread portion is a segment of said screw means which extends beyond said ramping surface of said one of said spool and said wedge and said thread engaging formations are formed in said ramping surface of said other of said spool and said wedge.

2. A connection pin assembly for attaching a replaceable implement to an earthworking bucket, comprising:

a) a spool having a first ramping surface;

b) a wedge having a second ramping surface, said first and second ramping surfaces cooperating to form a ramp arrangement which causes lateral expansion of said connection pin assembly upon relative axial movement in a first direction in which said spool and said wedge are drawn towards each other; and c) a screw means associated with one of said spool and said wedge for moving said one of said spool and said wedge axially relative to the other, the other of said spool and said wedge having formations which engage with a thread portion of said screw means such that rotation of said screw means drives said relative axial movement in said first direction and thereby said lateral expansion of said connection pin assembly, wherein said screw means is located in a ramping surface of said spool.

3. A connection pin assembly for attaching a replaceable implement to an earthworking bucket, comprising:

a) a spool having a first ramping surface;

b) a wedge having a second ramping surface, said first and second ramping surfaces co-operating to form a ramp arrangement which causes lateral expansion of said connection pin assembly upon relative axial movement in a first direction in which said spool and said wedge are drawn towards each other; and c) a screw means associated with one of said spool and said wedge for moving said one of said spool and said wedge axially relative to the other, said screw means having a rotational axis substantially parallel to the respective one of said first and said second ramping surfaces, the other of said spool and said wedge having formations which engage with a thread portion of said screw means, said thread portion being a segment of said screw means which extends beyond said ramping surface of said one of said spool and said wedge and said thread engaging formations being formed in said ramping surface of said other of said spool and said wedge and including a series of recesses and ribs, such that rotation of said screw means drives said relative axial movement in said first direction and thereby said lateral expansion of said connection pin assembly.

4. A connection pin assembly according to claim 3 wherein said ribs are spaced at a pitch substantially equal to a pitch of said thread portion.

5. A connection pin assembly according to claim 4 wherein said recesses are wider than a thickness of said thread portion.

6. A connection pin assembly according to claim 2, wherein:

said screw means has a rotational axis substantially parallel to the respective one of said first and said second ramping surfaces.

7. A connection pin assembly according to claim 1, wherein:

said screw means has a rotational axis substantially parallel to the respective one of said first and said second ramping surfaces.

8. A connection pin assembly according to claim 1 wherein said screw means has a drive portion accessible from an end of said spool.

9. A connection pin assembly according to claim 8 wherein said drive portion is located in a recess open to an end of said spool.

10. A connection pin assembly according to claim 9 wherein said spool is tapered toward an end and said drive portion is accessible from said end of said spool.

11. A connection pin assembly according to claim 8 wherein said spool is tapered toward an end and said drive portion is accessible from said end of said spool.

* * * * *